US009308724B2

(12) United States Patent
Gao et al.

(10) Patent No.: US 9,308,724 B2
(45) **Date of Patent: *Apr. 12, 2016**

(54) LIQUID EJECTING HEAD AND LIQUID EJECTING APPARATUS

(71) Applicant: Seiko Epson Corporation, Tokyo (JP)

(72) Inventors: Yue Gao, Matsumoto (JP); Yoshinao Miyata, Matsukawa (JP); Yuma Fukuzawa, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/805,946

(22) Filed: Jul. 22, 2015

(65) Prior Publication Data

US 2015/0321477 A1 Nov. 12, 2015

Related U.S. Application Data

(60) Division of application No. 14/578,903, filed on Dec. 22, 2014, now abandoned, which is a continuation of application No. 13/439,173, filed on Apr. 4, 2012, now Pat. No. 8,944,565.

(30) Foreign Application Priority Data

Apr. 6, 2011 (JP) ..... 2011-084920

(51) Int. Cl.
*B41J 2/14* (2006.01)
*B41J 2/16* (2006.01)

(52) U.S. Cl.
CPC ..... *B41J 2/14201* (2013.01); *B41J 2/14233* (2013.01); *B41J 2002/14241* (2013.01); *B41J 2002/14491* (2013.01)

(58) Field of Classification Search
CPC ..... B41J 2/14201; B41J 2/14072
USPC ..... 347/50
See application file for complete search history.

(56) References Cited

U.S. PATENT DOCUMENTS

| | | | |
|---|---|---|---|
| 4,429,321 | A | 1/1984 | Matsumoto |
| 5,175,565 | A | 12/1992 | Ishinaga et al. |
| 5,748,214 | A | 5/1998 | Usui et al. |
| 5,923,352 | A | 7/1999 | Kikuchi et al. |
| 5,929,881 | A | 7/1999 | Kitahara et al. |

(Continued)

FOREIGN PATENT DOCUMENTS

| | | | |
|---|---|---|---|
| JP | 2009-172878 | A | 8/2009 |
| JP | 2010-208138 | A | 9/2010 |

*Primary Examiner* — Matthew Luu
*Assistant Examiner* — Patrick King
(74) *Attorney, Agent, or Firm* — Harness, Dickey & Pierce, P.L.C.

(57) ABSTRACT

A liquid ejecting head includes a plurality of pressure generators each including a first electrode individually provided therefor, the first electrode being located on a face of the flow path plate so as to correspond to one of the pressure chambers, a piezoelectric layer provided on the first electrode, and a second electrode provided on the piezoelectric layer; a lead electrode electrically connected to the first electrode; and a conductive layer provided in a section where the first electrode is partially exposed, the section being located in a region where the second electrode is not provided and the piezoelectric layer is exposed, at least a part of the conductive layer being in contact with the first electrode. The lead electrode is connected to the first electrode via the conductive layer.

4 Claims, 6 Drawing Sheets

(56) References Cited

U.S. PATENT DOCUMENTS

| | | | | |
|---|---|---|---|---|
| 5,975,685 | A | 11/1999 | Asaba et al. | |
| 6,109,738 | A | 8/2000 | Miyata et al. | |
| 7,387,374 | B2 | 6/2008 | Kawamura | |
| 7,466,067 | B2 * | 12/2008 | Sugahara | B41J 2/14233 310/312 |
| 7,524,038 | B2 * | 4/2009 | Takahashi | B41J 2/14233 347/50 |
| 7,845,770 | B2 * | 12/2010 | Seto | B41J 2/14233 347/50 |
| 7,971,973 | B2 * | 7/2011 | Maeda | B41J 2/14233 347/50 |
| 8,029,109 | B2 | 10/2011 | Yazaki | |
| 8,414,110 | B2 * | 4/2013 | Kato | B41J 2/14233 347/50 |
| 8,419,172 | B2 | 4/2013 | Koseki | |
| 2003/0085961 | A1 | 5/2003 | Furuhata | |
| 2004/0070650 | A1 | 4/2004 | Sugahara | |
| 2006/0186766 | A1 | 8/2006 | Tsukamoto | |
| 2006/0203041 | A1 | 9/2006 | Shimada et al. | |
| 2006/0284940 | A1 | 12/2006 | Katayama | |
| 2006/0290747 | A1 | 12/2006 | Shimada et al. | |
| 2007/0257968 | A1 | 11/2007 | Hashimoto et al. | |
| 2009/0211790 | A1 | 8/2009 | Yokouchi | |
| 2010/0231650 | A1 | 9/2010 | Mita | |
| 2012/0206540 | A1 | 8/2012 | Kato et al. | |
| 2012/0212545 | A1 * | 8/2012 | Mizukami | B41J 2/14072 347/50 |
| 2012/0212547 | A1 | 8/2012 | Takemoto et al. | |

* cited by examiner

LIQUID EJECTING HEAD AND LIQUID EJECTING APPARATUS

CROSS-REFERENCE TO RELATED APPLICATIONS

This is a divisional patent application of U.S. application Ser. No. 14/578,903, filed Dec. 22, 2014, which is a continuation patent application of U.S. application Ser. No. 13/439,173, filed Apr. 4, 2012, now U.S. Pat. No. 8,944,565, issued Feb. 3, 2015, which claims priority to Japanese Patent Application No. 2011-084920, filed Apr. 6, 2011, all of which are hereby expressly incorporated by reference herein in their entireties.

BACKGROUND

1. Technical Field

The present invention relates to a liquid ejecting head and a liquid ejecting apparatus that eject a liquid through a nozzle, and more particularly to an ink jet recording head, an ink jet recording head unit, and an ink jet recording apparatus that dispense ink as an example of the liquid.

2. Related Art

Currently available liquid ejecting heads include an ink jet recording head that includes a flow path plate on which pressure chambers each communicating with a nozzle are aligned via partition walls formed therebetween. A piezoelectric element composed of a first electrode, a piezoelectric layer, and a second electrode is provided on a face of the flow path plate with a vibrating plate disposed therebetween, so that upon driving the piezoelectric element the pressure in the pressure chamber fluctuates, so as to dispense an ink droplet through the nozzle.

In some of such ink jet recording heads, the first electrode of the piezoelectric element disposed on the side of the vibrating plate is divided into individual electrodes that each correspond to one of the pressure chambers, while the second electrode continuously extends over the plurality of pressure chambers thus to serve as a common electrode, for example as disclosed in JP-A-2009-172878.

In the ink jet recording head according to the cited document, a lead electrode is provided for connection with the first electrode, i.e., each of the individual electrodes of the piezoelectric element. However, with the configuration according to the cited document, in which the first electrode is divided into the individual electrodes and the second electrode serves as the common electrode, the lead electrode is connected to the first electrode which is drawn out from the piezoelectric element, unlike a lead electrode connected to the second electrode. Accordingly, the connection point between first electrode and the lead electrode is located away from the substantial operative portion of the piezoelectric element, which results in degradation of the driving efficiency of the piezoelectric element originating from a voltage drop. Furthermore, the process of exposing the first electrode and connecting the lead electrode thereto may incur imperfect connection.

Therefore, it is expected to establish a connection structure between the lead electrode and the first electrode that allows the piezoelectric element to be efficiently driven.

SUMMARY

An advantage of some aspects of the invention is that a liquid ejecting head and a liquid ejecting apparatus are provided in which a lead electrode and a first electrode are connected to each other at a position close to a piezoelectric element, so that the piezoelectric element can be efficiently driven.

In an aspect, the invention provides a liquid ejecting head including a flow path plate including a plurality of pressure chambers communicating with a nozzle that ejects a liquid; a plurality of pressure generators each including a first electrode individually provided therefor, the first electrode being located on a face of the flow path plate opposite the pressure chamber so as to correspond to one of the pressure chambers, a piezoelectric layer provided on the first electrode, and a second electrode provided on the piezoelectric layer; a lead electrode electrically connected to the first electrode; and a conductive layer provided in a section where the first electrode is partially exposed, the section being located in a region where the second electrode is not provided and the piezoelectric layer is exposed, at least a part of the conductive layer being in contact with the first electrode; wherein the second electrode constitutes a common electrode for the plurality of pressure generators, and the lead electrode is connected to the first electrode via the conductive layer.

In the liquid ejecting head thus configured, the conductive layer is provided so as to cover the region where the first electrode is partially exposed, and the lead electrode is connected to the conductive layer. Such a configuration suppresses imperfect connection between the first electrode and the lead electrode, to thereby allow the piezoelectric element to be efficiently driven.

Preferably, the lead electrode may be connected via the conductive layer to a portion of the first electrode exposed in a through hole formed in the region where the second electrode is not provided and the piezoelectric layer is exposed. Providing thus the conductive layer so as to cover the first electrode exposed in the through hole assures that the electrical connection between the first electrode and the conductive layer is secured, and hence connecting the lead electrode to the conductive layer results in achieving secure electrical connection with the first electrode. In addition, connecting the first electrode and the lead electrode via the through hole allows the connection to be made at a position closest possible to the operative unit.

Preferably, the lead electrode may be connected via the conductive layer to a portion of the first electrode exposed in a cut-away portion formed in the region where the second electrode is not provided and the piezoelectric layer is exposed. Providing thus the conductive layer so as to cover the first electrode exposed in the cut-away portion assures that the electrical connection between the first electrode and the conductive layer is secured, and hence connecting the lead electrode to the conductive layer results in achieving secure electrical connection with the first electrode. In addition, connecting the first electrode and the lead electrode via the cut-away portion allows the connection to be made at a position closest possible to the operative unit, and also further assures the electrical connection between the first electrode and the lead electrode.

Preferably, openings may be formed between the plurality of pressure generators, by removing the second electrode and the piezoelectric layer. Such a configuration assures the electrical connection between the first electrode and the lead electrode, in the case where openings are provided on the respective sides of the operative unit so as to improve displacement efficiency.

In another aspect, the invention provides a liquid ejecting apparatus including the liquid ejecting head according to the foregoing aspects. With such a configuration, a liquid ejecting apparatus can be obtained that includes the liquid ejecting head capable of suppressing imperfect connection between the first electrode and the lead electrode, thus allowing the piezoelectric element to be efficiently driven.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereafter, embodiments of the invention will be described in details.

First Embodiment

Figure 1:
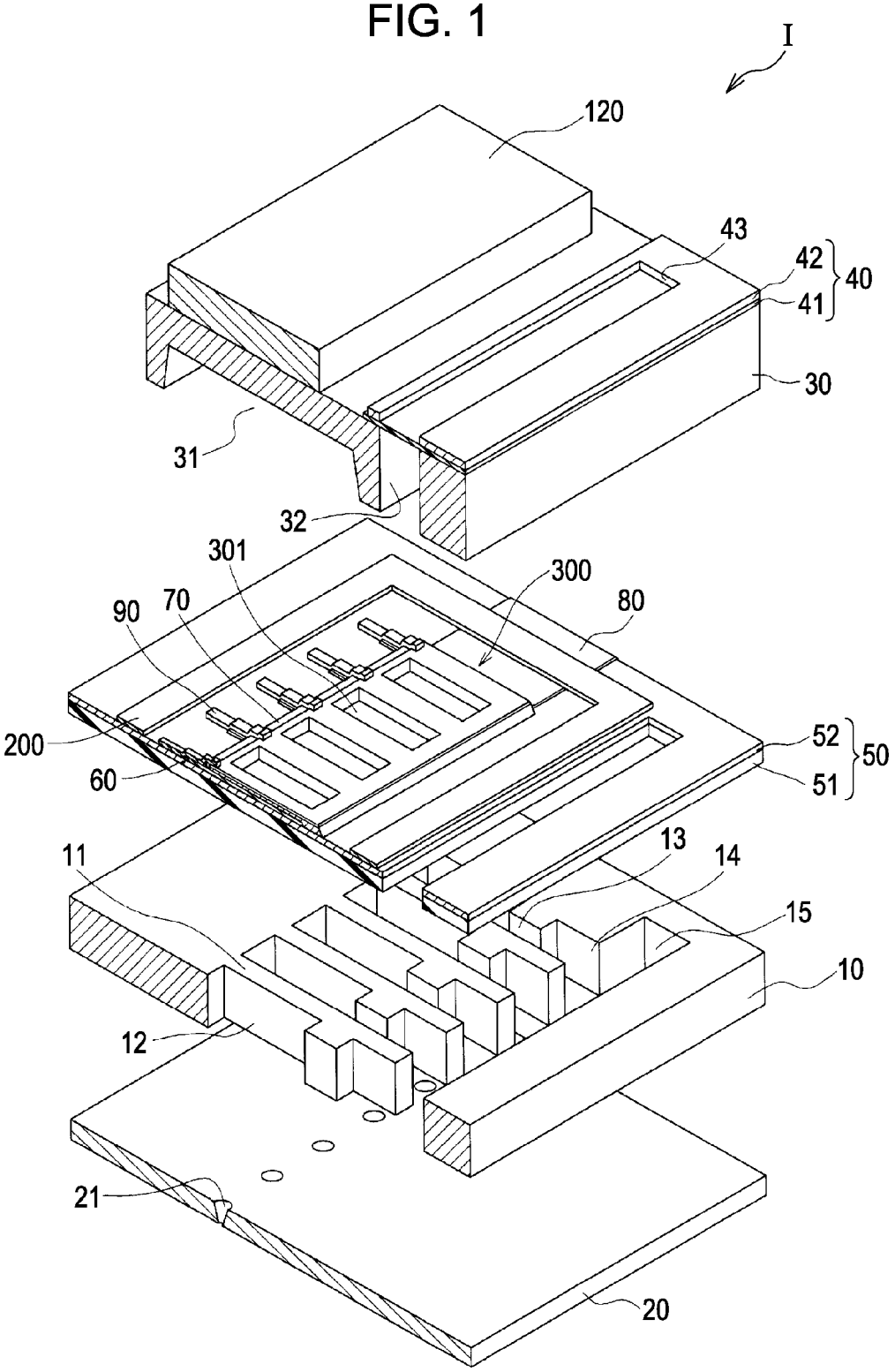
FIG. 1 is an exploded perspective view of a recording head according to a first embodiment of the invention.
Figure 2:
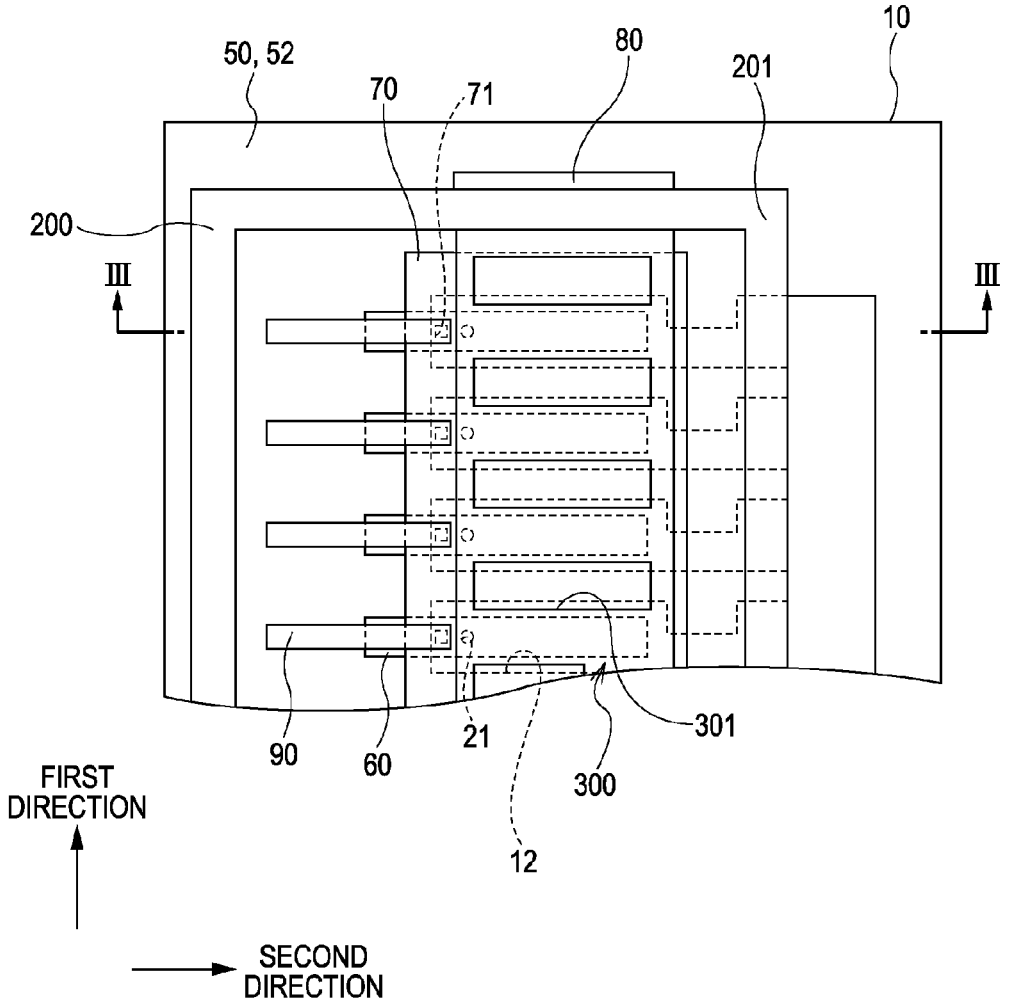
FIG. 2 is a fragmentary plan view of the recording head according to the first embodiment.
Figure 3:
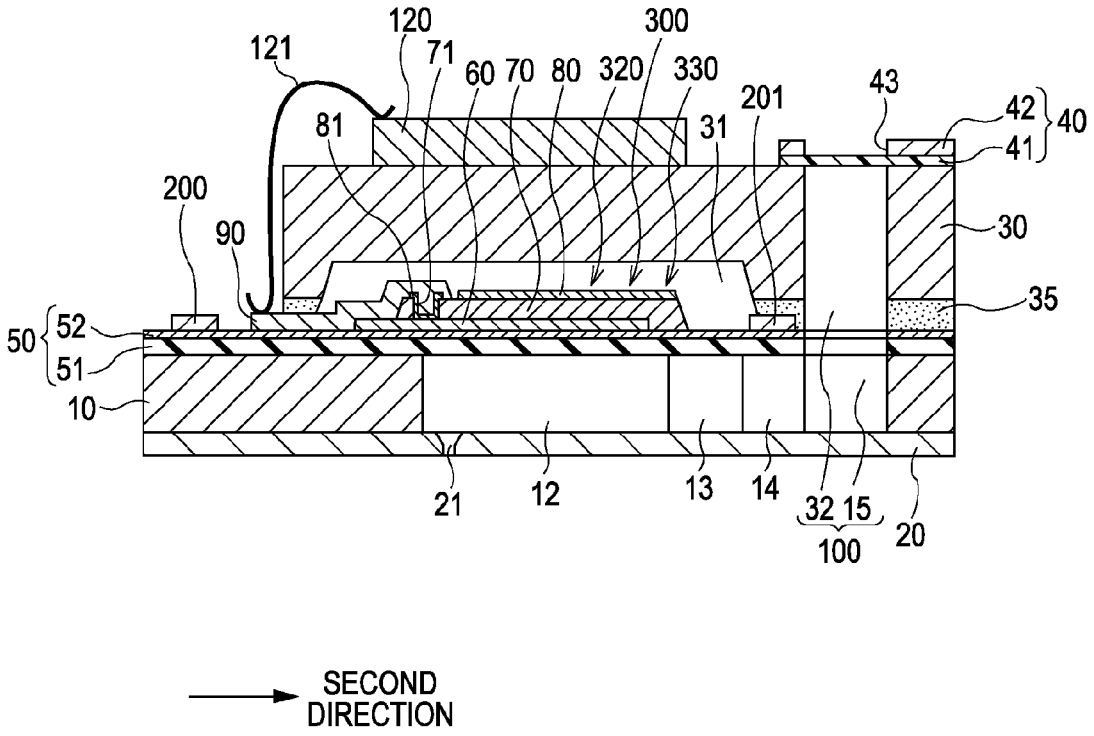
FIG. 3 is a cross-sectional view taken along a line III-III in FIG. 2.

FIG. 1 is an exploded perspective view of an ink jet recording head exemplifying a liquid recording head according to a first embodiment of the invention; FIG. 2 is a fragmentary plan view of a flow path plate of the ink jet recording head; and FIG. 3 is a cross-sectional view taken along a line III-III in FIG. 2.

As shown in FIG. 1, the flow path plate 10 constituting a part of the ink jet recording head I includes a plurality of pressure chambers 12 defined by partition walls 11 so as to be aligned on the flow path plate 10. The direction in which the pressure chambers 12 are aligned will be referred to as alignment direction or first direction. The flow path plate 10 also includes an ink supply path 13 and a communication path 14 formed at an end portion of each of the pressure chambers 12 in a direction intersecting with the alignment direction (hereinafter, second direction), and defined by the partition walls 11 so as to communicate with each of the pressure chambers 12. A communication channel 15 is provided on an outer side of the communication paths 14, so as to communicate with each of them.

The communication channel 15 communicates with a manifold unit 32 of a cover member 30, which will be subsequently described, so as to form a part of a manifold 100 serving as a common ink chamber (liquid chamber) for the respective pressure chambers 12. The ink supply path 13 is made smaller in cross-sectional area than the pressure chamber 12, so as to apply a constant flow path resistance to the ink introduced from the communication channel 15 into the pressure chamber 12. The communication path 14 is formed by extending the partition wall 11 on the respective sides of the pressure chamber 12 toward the communication channel 15, so as to divide the space between the ink supply path 13 and the communication channel 15.

For example a silicon monocrystalline substrate may be suitably employed as the flow path plate 10, while a glass ceramic, a stainless steel may also be employed instead.

A nozzle plate 20 perforated with nozzle orifices is fixed to a face of the flow path plate 10, via an adhesive, a hot-melt film, or the like. Examples of the material of the nozzle plate 20 include a glass ceramic, a silicon monocrystalline substrate, and a stainless steel.

A vibrating plate 50 including an elastic layer 51 formed by, for example, thermal oxidation of the flow path plate 10 is provided on the other face thereof. Thus, one of the sides of the pressure chambers 12 and peripheral portions is constituted of the vibrating plate (elastic layer 51).

In this embodiment, an insulative layer 52 which is an oxide layer of a material different from that of the elastic layer 51 is provided thereon, so that the elastic layer 51 and the insulative layer 52 constitute the vibrating plate 50. A piezoelectric device 300 including a first electrode 60 formed on the vibrating plate 50, a piezoelectric layer 70 formed on the first electrode 60, and a second electrode 80 formed on the piezoelectric layer 70 is provided on the vibrating plate 50, the piezoelectric device 300 serving as a pressure generator.

In the piezoelectric device 300, generally, one of the electrodes serves as a common electrode and others serve as independently working individual electrodes. In this embodiment, the first electrode 60 serves as the individual electrode of the respective piezoelectric operative units 320 acting as the substantial driving unit of the piezoelectric device 300, and the second electrode 80 serves as the common electrode shared by the plurality of piezoelectric operative units 320.

The piezoelectric device 300 and the vibrating plate 50 to be displaced upon driving the piezoelectric device 300 will be collectively referred to as actuator unit. Although the vibrating plate 50 is composed of the elastic layer 51 and the insulative layer 52 in this embodiment, the configuration of the vibrating plate 50 is not specifically limited. For example, the first electrode 60 of the piezoelectric device 300 may act also as the vibrating plate 50, or the piezoelectric device 300 itself may act as the vibrating plate 50.

The configuration of the piezoelectric device 300 according to this embodiment will now be described in detail hereunder. As shown in FIG. 3, the piezoelectric device 300 includes the piezoelectric operative unit 320 including the first electrode 60, the piezoelectric layer 70, and the second electrode 80 sequentially stacked so as to produce piezoelectric distortion upon applying a voltage to the respective electrodes, and a piezoelectric non-operative unit 330 that does not actually work despite including the piezoelectric layer 70 extending from the piezoelectric operative unit 320 and the first electrode 60 or the second electrode 80. The boundary between the piezoelectric operative unit 320 and the piezoelectric non-operative unit 330 is defined by the end portion of the first electrode 60 and the second electrode 80. In this embodiment, each of the piezoelectric operative units 320 is disposed so as to oppose a corresponding one of the pressure chambers 12, and the piezoelectric non-operative units 330 are located on the outer side of the piezoelectric operative unit 320 in the second direction, so as to extend to a position outside of the pressure chamber 12 in the second direction. The piezoelectric non-operative unit 330 is also formed between the adjacent piezoelectric operative units 320, so as to extend to an outer side of the pressure chamber 12 in the alignment direction (first direction). More specifically, as shown in FIG. 3, the end portion of the piezoelectric operative unit 320 on the side of ink supply path 13, in the second direction intersecting with the alignment direction of the pressure chambers 12 (direction orthogonal to the alignment direction), is defined by the longitudinal end portion of the first electrode 60, and the piezoelectric layer 70 and the second electrode 80 extend to an outer position of the longitudinal end portion of the first electrode 60. Further, in the second direction of the pressure chambers 12, the end portion of the piezoelectric operative unit 320 opposite ink supply path 13 (on the side of the nozzle orifice 21) is defined by the end portion of the second electrode 80, and the first electrode 60 and the piezoelectric layer 70 extend to an outer position of the end portion of the second electrode 80.

In addition, the portion of the first electrode 60 opposing the pressure chamber 12 is narrower than the width thereof (size of the pressure chamber 12 in the alignment direction, i.e., the first direction), and the end portion of the first electrode 60 in the width direction defines the end portion of the piezoelectric operative unit 320 in the width direction.

The piezoelectric layer 70, which partially includes openings 301, is formed so as to continuously extend over a region opposing the plurality of pressure chambers 12. In other words, the piezoelectric layer 70 is formed so as to extend to an outer position of the end portion of the first electrode 60 in the width direction. Further, as shown in FIG. 3, in the second direction orthogonal to the alignment direction of the pressure chamber 12 (first direction), the piezoelectric layer 70 extends to an outer position of the end portion of the pressure chamber 12 in the second direction. Here, the openings 301 are formed by completely removing the second electrode 80 and the piezoelectric layer 70, between the piezoelectric devices 300, i.e., at positions opposing the respective partition walls 11 defining the pressure chambers 12.

The second electrode 80 is continuously formed on the piezoelectric layer 70, over the regions opposing the plurality of pressure chambers 12 and the partition walls 11. In addition, as shown in FIG. 3, the end portion of the second electrode 80 is located so as to correspond to the pressure chamber 12, at a position on the side of the nozzle orifice 21 in the second direction, as described above. Such end portion of the second electrode 80 defines the boundary between the piezoelectric operative unit 320 and the piezoelectric non-operative unit 330 on one side in the longitudinal direction (on the side of the nozzle orifice 21).

Now, each of the first electrodes 60 is formed so as to extend to an outer position of the end portion of the pressure chamber 12 in the second direction opposite the ink supply path 13, and a lead electrode 90 made of Au or another suitable material is connected to the extended portion of the first electrode 60. In addition a driver circuit 120, to be subsequently described in detail, is connected to each piezoelectric device 300 via the lead electrode 90, by means of a connection wiring 121 such as a bonding wire.

In this embodiment, a through hole 71 serving as a contact hole is provided in a portion of the piezoelectric layer 70 outside of the piezoelectric operative unit 320, in other words in a region where the second electrode 80 is not provided and the piezoelectric layer 70 is exposed, so as to bring the connection point between the first electrode 60 and the lead electrode 90 as close as possible to the piezoelectric operative unit 320. In addition, a conductive layer 81, at least a part of which is connected to the first electrode 60, is provided so as to cover the first electrode 60 exposed in the through hole 71 and the inner wall and the peripheral edge of the opening of the through hole 71, the conductive layer 81 being electrically discontinuous with the second electrode 80, and the lead electrode 90 is disposed so as to be connected to the conductive layer 81. Here, the through hole 71 has a size smaller than the width of the first electrode 60 in the alignment direction.

Figure 5A:
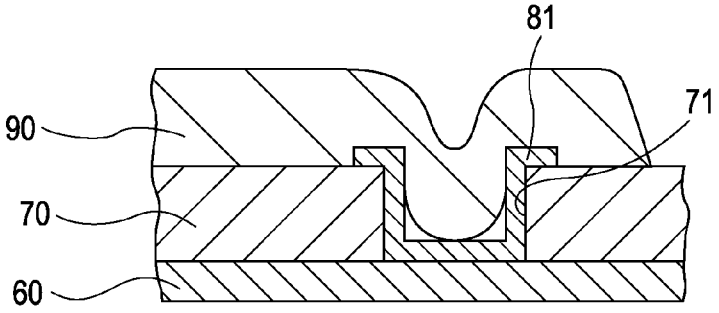
FIGS. 5A and 5B are cross-sectional views for explaining essential portions of the first and the second embodiment.

Such a configuration allows the lead electrode 90 and the first electrode 60 to be connected at a position close to the piezoelectric operative unit 320, yet where a failure such as short circuit with the second electrode 80 is not likely to take place, thereby minimizing the disadvantage of a voltage drop. In addition, whereas the second electrode 80 and the lead electrode 90 may be formed by sputtering for example, the lead electrode 90 is formed in a relatively thick layer and hence it is difficult to achieve complete connection with the first electrode 60 at a portion around the through hole 71 serving as the contact hole, because of differences in deposition rate. However, the presence of the conductive layer 81 between the lead electrode 90 and the first electrode 60 assures the connection therebetween. More specifically, although the conductive layer 81 is deposited at the same time as the second electrode 80, since the conductive layer 81 is thinner than the lead electrode 90, the conductive layer 81 can be deposited so as to securely achieve the connection with the first electrode 60, even in the fine-sized through hole 71. Accordingly, the connection between the lead electrode 90 and the first electrode 60 can be securely achieved via the conductive layer 81, even though the lead electrode 90 is not formed so as to completely fill in the through hole 71, for example as shown in FIG. 5A.

Referring again to FIG. 2, interconnect electrodes 200, 201 are provided on the flow path plate 10 (more accurately, on the vibrating plate 50), so as to continuously extend in the alignment direction of the piezoelectric operative unit 320, along the respective sides thereof in the second direction. The interconnect electrodes 200, 201 are continuous with each other at the respective end portions in the alignment direction of the piezoelectric operative unit 320 (first direction) thus being electrically connected with each other, and are also electrically connected to the second electrode 80 at the respective end portions in the alignment direction of the piezoelectric operative unit 320, so as to prevent a voltage drop of the piezoelectric device 300 in the alignment direction.

Further, in the piezoelectric device 300 according to this embodiment the first electrode 60 serves as the individual electrode and the second electrode 80 serves as the common electrode, and one of the end portions of the first electrode 60 in the second direction is covered with the piezoelectric layer 70. Accordingly a current leak between the first electrode 60 and the second electrode 80 can be suppressed, and the piezoelectric device 300 can be prevented from breaking down. Here, in the case where the first electrode 60 and the second electrode 80 are exposed in close positions, the current leaks along the surface of the piezoelectric layer 70 and collapses the piezoelectric layer 70. Further, although the other end portion of the first electrode 60 in the second direction is not covered with the piezoelectric layer 70, this does not constitute an issue because the exposed portions of the first electrode 60 and the second electrode 80 are sufficiently distant from each other. Such a configuration eliminates the need to cover the piezoelectric device 300 with a cover layer such as aluminum oxide, thereby suppressing the disturbance against the displacement of the piezoelectric device 300 originating from the presence of the cover layer, thus enabling the optimum displacement to be secured.

On the flow path plate 10 having thereon the thus-configured piezoelectric device 300, a cover member 30 including a piezoelectric device chamber 31, which is a space for protecting the piezoelectric device 300, is mounted via an adhesive 35. Since the piezoelectric device 300 is accommodated inside the piezoelectric device chamber 31, and is hence barely affected by exterior environments. The cover member 30 also includes a manifold unit 32 in a portion thereof corresponding to the communication channel of the flow path plate 10. The manifold unit 32 communicates, as described earlier, with the communication channel 15 of the flow path plate 10, thus to constitute a manifold 100 serving as the common ink chamber shared by the pressure chambers 12.

In addition, a driver circuit 120 that drives the aligned piezoelectric devices 300 is fixed on the cover member 30. The driver circuit 120 may be constituted of a circuit substrate or a semiconductor integrated circuit (IC), for example. The lead electrode 90 is drawn to outside of the piezoelectric device chamber 31, and the lead electrode drawn out and the driver circuit 120 are electrically connected via a connection wiring 121 made of a conductive wire such as a bonding wire.

To the cover member 30, further, a compliance substrate 40 including a sealing film 41 and a fixing plate 42 is attached. The sealing film 41 is made of a flexible material having low rigidity, and serves to seal one side of the manifold 100. The fixing plate 42 is made of a hard material such as a metal. The fixing plate 42 includes an opening 43 formed through the entire thickness thereof, in a region opposing the manifolds 100. Accordingly, the one side of the manifold 100 is sealed only with the flexible sealing film 41.

In the ink jet recording head I thus configured according to this embodiment, ink is introduced from an external ink supplier (not shown). After the flow path is filled with the ink from the manifold 100 to the nozzle orifice 21, when a voltage is applied to the piezoelectric devices 300 respectively corresponding to the pressure chambers 12 in accordance with recording signals from the driver circuit 120, the piezoelectric device 300 is deflected so as to increase the pressure inside the pressure chambers 12, and ink droplets are ejected through the nozzle orifices 21.

Second Embodiment

Figure 4A:
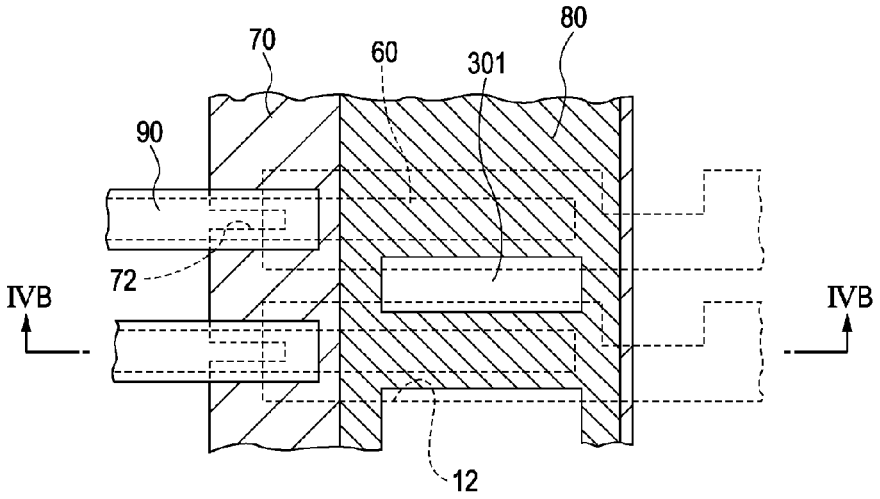
FIG. 4A is an enlarged plan view of a recording head according to a second embodiment of the invention.
Figure 4B:
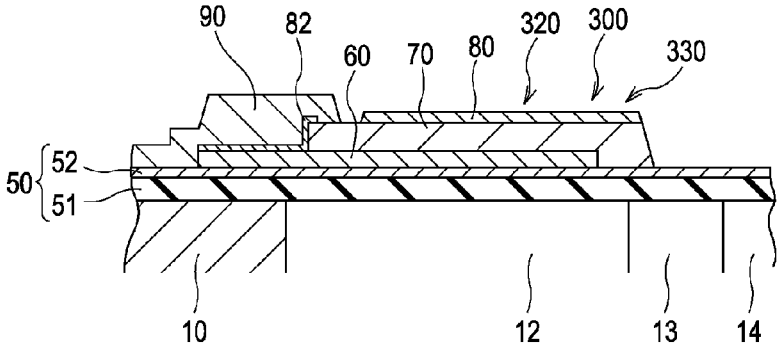
FIG. 4B is a cross-sectional view taken along a line IVB-IVB in FIG. 4A.

FIG. 4A is an enlarged plan view of an ink jet recording head exemplifying a liquid ejecting head according to a second embodiment of the invention, and FIG. 4B is a cross-sectional view taken along a line IVB-IVB in FIG. 4A. In these drawings the constituents same as those of the first embodiment will be given the same numeral, and the description thereof will not be repeated.

As shown in FIGS. 4A and 4B, the piezoelectric device 300 according to the second embodiment includes, instead of the through hole 71, a cut-away portion 72 formed by cutting away an end portion of the piezoelectric layer 70 on the side of the lead electrode 90 in the second direction up to a position close to the piezoelectric operative unit 320, so as to expose the first electrode 60. Here, the cut-away portion 72 is narrower than the first electrode 60 in the alignment direction of the piezoelectric device 300. In addition, a conductive layer 82, deposited at the same time as the second electrode 80, is provided so as to cover the first electrode 60 exposed in the cut-away portion 72 and the inner wall and the peripheral edge of the opening of the cut-away portion 72, and the lead electrode 90 is disposed so as to be connected to the conductive layer 82.

Figure 5B:
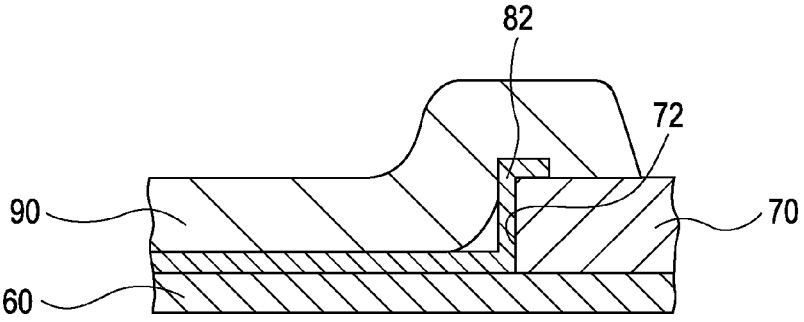

Providing thus the cut-away portion 72 allows the lead electrode 90 and the first electrode 60 to be connected at a position close to the piezoelectric operative unit 320, yet where a failure such as short circuit with the second electrode 80 is not likely to take place, thereby minimizing the disadvantage of a voltage drop. In addition, whereas the second electrode 80 and the lead electrode 90 may be formed by sputtering for example, the lead electrode 90 is formed in a relatively thick layer and hence it is difficult to achieve complete connection with the first electrode 60 at a portion around the cut-away portion 72, because of differences in deposition rate. However, the presence of the conductive layer 82 between the lead electrode 90 and the first electrode 60 assures the connection therebetween. More specifically, although the conductive layer 82 is deposited at the same time as the second electrode 80, since the conductive layer 82 is thinner than the lead electrode 90, the conductive layer 82 can be deposited so as to securely achieve the connection with the first electrode 60, even in the fine-sized cut-away portion 72. In addition, the conductive layer 82 is formed so as to contact the first electrode 60 over a more extensive range compared with the case of forming the through hole 71, which results in more efficient connection between the first electrode 60 and the conductive layer 82. Accordingly, the connection between the lead electrode 90 and the first electrode 60 can be securely achieved via the conductive layer 82, even though the lead electrode 90 is not formed so as to completely fill in the cut-away portion 72, for example as shown in FIG. 5B.

Additional Embodiments

Although the embodiments of the invention have been described above, the fundamental structure of the invention is not limited to the foregoing embodiments.

Figure 6:
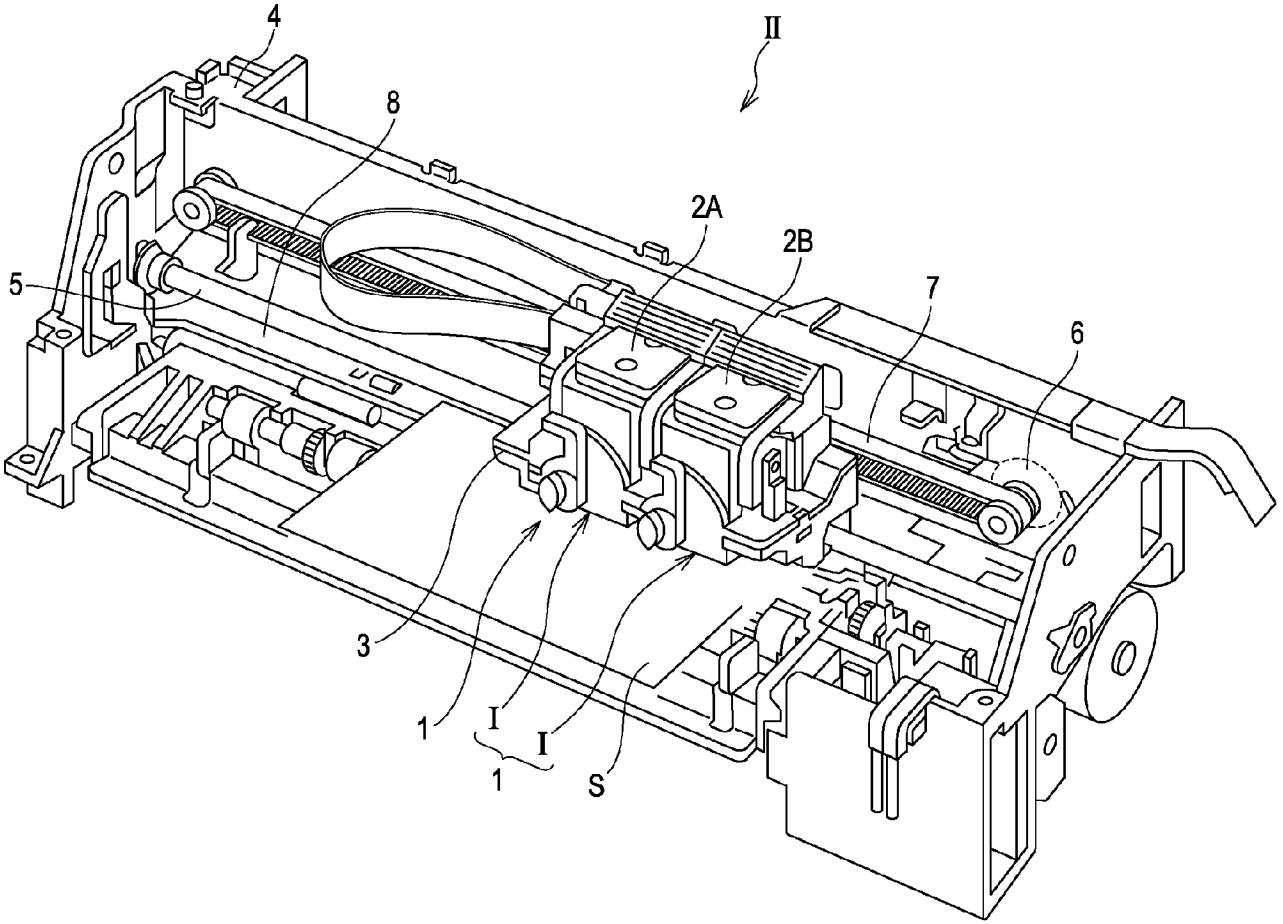
FIG. 6 is a perspective view showing a general configuration of a recording apparatus according to an embodiment of the invention.

The foregoing ink jet recording head I may constitute a part of an ink jet recording head unit that includes ink flow paths communicating with ink cartridges or the like, and be incorporated in an ink jet recording apparatus. FIG. 6 is a perspective view showing a general configuration of the ink jet recording apparatus.

As shown in FIG. 6, the ink jet recording apparatus II includes an ink jet recording head unit 1 (hereinafter, simply head unit 1 as the case may be) including a plurality of the ink jet recording heads I. The head unit 1 includes detachable cartridges 2A and 2B serving as the ink supplier, and a carriage 3 with the head unit 1 mounted thereon is provided so as to axially move along a carriage shaft 5 mounted in the apparatus main body 4. The head units 1 is configured to dispense, for example, a black ink composition and color ink composition. When a driving force of a driving motor 6 is transmitted to the carriage 3 through a plurality of gears (not shown) and a timing belt 7, the carriage 3 with the recording head unit 1 mounted thereon is caused to move along the carriage shaft 5. The apparatus main body 4 includes a platen 8 provided along the carriage shaft 5, so that a recording sheet S, a recording medium such as paper supplied by a feed roller (not shown), is wound on the platen 8 thus to be transported thereon.

Although the head unit 1 including the plurality of ink jet recording heads I is mounted in the ink jet recording apparatus II in the example given above, the head unit 1 including a single ink jet recording head I may be mounted in the ink jet recording apparatus II, and two or more head units 1 may be mounted in the ink jet recording apparatus II. Further, the ink jet recording head I may be directly mounted in the ink jet recording apparatus II.

Still further, although the liquid ejecting head according to the invention is exemplified by the ink jet recording head in the foregoing embodiments, the invention is broadly applicable to liquid ejecting heads in general, and to those that eject a liquid other than the ink. Examples of such liquid ejecting head include recording heads for use in image recording apparatuses such as a printer, color material ejecting heads employed for manufacturing a color filter for an LCD and the like, electrode material ejecting heads employed for manufacturing an electrode in an organic EL display or a field emission display (FED), and an bioorganic ejecting head for manufacturing a biochip.

What is claimed is:

1. A liquid ejecting head comprising:

a flow path plate including a plurality of pressure chambers communicating with a nozzle that ejects a liquid;

a plurality of pressure generators each including a first electrode provided above the flow path plate, a piezoelectric layer provided on the first electrode, and a second electrode provided on the piezoelectric layer;

a lead electrode electrically connected to the first electrode; and a conductive layer provided in a section where the first electrode is partially exposed, the section being located in a region where the second electrode is not provided and the piezoelectric layer is exposed, at least a part of the conductive layer being in contact with the first electrode, wherein the first electrode is individually provided for each of the plurality of pressure chambers, the second electrode constitutes a common electrode for the plurality of pressure generators, and the lead electrode is connected to the first electrode via the conductive layer, and an opening is formed between the plurality of pressure generators by removing the second electrode and the piezoelectric layer, wherein the lead electrode is connected via the conductive layer to a portion of the first electrode exposed in a cut-away portion formed in the region where the second electrode is not provided and the piezoelectric layer is exposed.

2. A liquid ejecting head comprising:

a flow path plate including a plurality of pressure chambers communicating with a nozzle that ejects a liquid;

a plurality of pressure generators each including a first electrode provided above the flow path plate, a piezoelectric layer provided on the first electrode, and a second electrode provided on the piezoelectric layer;

a lead electrode electrically connected to the first electrode; and a conductive layer provided in a section where the first electrode is partially exposed, the section being located in a region where the second electrode is not provided and the piezoelectric layer is exposed, at least a part of the conductive layer being in contact with the first electrode, wherein the first electrode is individually provided for each of the plurality of pressure chambers, the second electrode constitutes a common electrode for the plurality of pressure generators, and the lead electrode is connected to the first electrode via the conductive layer, and an opening is formed between the plurality of pressure generators by removing the second electrode and the piezoelectric layer, wherein the lead electrode is connected via the conductive layer to a portion of the first electrode exposed in a through hole formed in the region where the second electrode is not provided and the piezoelectric layer is exposed.

3. A liquid ejecting apparatus comprising the liquid ejecting head according to claim 1.

4. A liquid ejecting apparatus comprising the liquid ejecting head according to claim 2.

* * * * *